United States Patent [19]

Kinzer et al.

[11] 4,144,053

[45] Mar. 13, 1979

[54] PROCESSES FOR BLAST FURNACE OPERATIONS

[75] Inventors: William K. Kinzer, Northfield; Robert E. Kusner, Brecksville, both of Ohio

[73] Assignee: Republic Steel Corporation, Cleveland, Ohio

[21] Appl. No.: 738,446

[22] Filed: Nov. 3, 1976

[51] Int. Cl.[2] ..... C21B 5/04

[52] U.S. Cl. ..... 75/42; 75/257; 75/30

[58] Field of Search ..... 75/42, 41, 257, 30; 201/20; 44/16 R

[56] References Cited

U.S. PATENT DOCUMENTS

| | | | |
|---|---|---|---|
| 945,331 | 1/1910 | Koppers | 201/20 |
| 2,473,987 | 6/1949 | Brandon | 75/42 |
| 3,190,745 | 6/1965 | Triska | 75/41 |
| 4,015,977 | 4/1977 | Crawford | 75/42 X |

*Primary Examiner*—M. J. Andrews

*Attorney, Agent, or Firm*—Watts, Hoffmann, Fisher & Heinke & Co.

[57] ABSTRACT

A process of operating a blast furnace characterized by the steps of employing silica enriched coke as the coke charge, and allowing the silica to react with condensed alkalies in the furnace to form alkali silicates and thereby minimize degradation of the coke during oxidation. A silica enriched coke especially adapted for blast furnace operations containing added silica in a minimum amount of about 1% by weight, and a method of making the same by dispersing and blending the silica in the coal in a minimum amount of about 0.7% by weight before coking.

3 Claims, No Drawings

PROCESSES FOR BLAST FURNACE OPERATIONS

BACKGROUND OF THE INVENTION

The present invention relates generally to improvements in blast furnace operations, and more specifically to methods and materials for improving the quality of blast furnace coke.

Investigations of blast furnaces that produce less hot metal than expected has shown that coke at the level of the furnace tuyeres was smaller in size, less permeable to air flow, more readilly abraided, higher in alkali content, and more reactive with $CO_2$ than the coke fed into the blast furnace. In coke $CO_2$ reactivity tests that were conducted, the "tuyere" coke resulted in more coke fines than production coke. These poor quality characteristics result from the catalytic effect of the higher amounts of alkali contained in "tuyere" coke on increasing the coke reactivity, promoting coke degradation, and subsequently increasing the resistance to air passage.

Alkalis, mainly, sodium and potassium, are carried into the blast furnace stack as constituents in the iron burden, the flux and the coke. For example, the burden may contribute up to 28% or more of the inputed $K_2O$ and from 60 to 76% or more of the inputed $Na_2O$, and the coke may contribute from 64 to 73% of the $K_2O$ and from 19 to 32% of the $Na_2O$. Depending upon the slag basicity and high temperature, part of these alkalis are removed with the slag, primarily as alkali silicates. Because of the reducing and high temperature conditions existing in the bosh region of the furnace, the remainder of the alkalis are vaporized as oxides or as metal vapors and are carried with the ascending bosh gases to the upper stack where a portion of the vaporized alkalis are condensed on the relatively cool descending materials, including the coke, charged into the furnace.

It has been shown that the alkalis that deposit on the descending coke charge appreciably accelerate the solution loss reaction on the coke-carbon reaction ($C + CO_2 = 2CO$). It has also been demonstrated that, in direct relation to increased coke reaction, the reacted coke exhibits an increased tendency to degrade into fines that tend to plug the void spaces in the bosh zone so as to impede the flow of ascending hot reducing gases and descending liquids, i.e. slag and hot metal. This reduces the furnace productivity and causes a tendency for the furnace to hang.

SUMMARY OF THE INVENTION

The purpose of the present invention is to improve the quality of blast furnace coke by retarding its degradation during oxidation in an alkali environment and thereby improve the performance of blast furnace operations.

It has been discovered that the deleterious effect of condensed alkali vapors on a coke charge in a blast furnace can be minimized by enriching the coke with a finely dispersed addition of silica, such as silica flour, fire clay, quartzite or the like. The siliceous material in or on the coke reacts with the condensed alkalis to form alkali silicates which do not catalyze the carbon-$CO_2$ reaction. In addition, the silicates will be removed from the furnace via the slag, thus minimizing the vaporization, refluxing, and accumulation of alkalis in the furnace. The reduction of the alkalis in the furnace also minimizes the formation of scabs on the furnace walls.

In accordance with the foregoing, the present invention provides an impovement in the process of operating a blast furnace by charging ore, coke and flux into the furnace and reducing the ore by oxidation of the coke characterized by the steps of employing coke enriched with at least 1% by weight of a finely dispersed silica addition as the coke charge, and allowing the silica to react with condensed alkalis on the coke to form alkali silicates and thereby retard coke degradation.

According to another aspect of the invention, there is provided a silica enriched coke especially adapted for blast furnace operations containing added silica in an amount of at least 1% by weight.

Still another aspect of the invention is the provision of a method of making silica enriched coke comprising the steps of coking coal containing an addition of finely disbursed silica in an amount of at least 0.7% by weight of the coal.

In more preferred embodiments of the invention, the silica addition is in a range of from about 1.4 to about 2.8% by weight of the coal or from about 2 to about 4% by weight of the coke and has a size no greater than about 75% by weight minus 100 mesh (Tyler). As hereinafter discussed in more detail, results of tests show that coked blends enriched with a minimum of about 1% by weight of added silica, and more preferably a minimum of about 2% by weight of added silica having a size no greater than about 75% minus 100 mesh, is effective to retard significantly coke degradation resulting from an alkali environment. Tests have also shown that the stability factor of coked blends, as determined by a standard ASTM Tumble Test, is not significantly changed by silica additions up to at least 4% by weight of the coked blend.

As used herein, the term "enriched" refers to coke to which silica has been added, such as by dispersing and blending the silica in the coal prior to coking or by coating the coke in any suitable manner with a siliceous material. The term "silica" encompasses ground silica or silica flour which is substantially 100% silica and siliceous materials such as fire clay, quartzite and the like which may contain ingredients in addition to silica, such as alumina, as well as fluxing impurities.

Further advantages and a fuller understanding of the invention will become apparent from the following detailed description of the preferred embodiments.

DESCRIPTION OF PREFERRED EMBODIMENTS

The effect of added silica on reducing coke breakdown or degradation was demonstrated by $CO_2$ reactivity tests conducted on coked blends which contained different amounts and size fractions of the added silica. In carrying out these tests, the silica was blended with coals used to produce production coke known to exhibit appreciable degradation in the presence of alkali. The blends were coked in a 500 pound movable wall oven, and samples of the coked blends were crushed and screened to obtain a minus 1½ inch; plus 1 inch size fraction that was used for the tests.

A portion of the sized coke was impregnated with alkali (1.5 parts by weight sodium as $Na_2CO_3$ per 100 parts by weight coke). The procedure for impregnating the coke comprised the steps of placing a weighed amount of the 1½ inch by 1 inch size in a stainless steel basket and preheating it in an oven at 300° F. for about ½ hour. The stainless steel basket containing the heated coke was immersed in a hot $Na_2CO_3$ solution and allowed to remain in the solution until bubbling stopped. The coke was then removed from the solution, drained, and dried in an oven for about 2 hours at 320° F.

The alkali impregnated coke and the unimpregnated coke was tested for $CO_2$ reactivity and coke degradation. The coke reactivity was determined by measuring the weight loss of coke resulting from the reaction of carbon dioxide with coke carbon to form carbon monoxide for a 2 hour period at a temperature of about 1800° F. The coke reactivity value was then expressed as a weight percent of the original coke lost as a result of the reaction. The specific procedure used for measuring $CO_2$ reactivity involved placing a weighed amount of the 1½ inch by 1 inch size coke in a reactor vessel. The reactor was positioned in an electric furnace and balanced by counterweights. The atmosphere within the reactor was continually purged with nitrogen during heating and cool down. After reaching a coke bed temperature of about 1800° F., carbon dioxide was metered into the reactor at a rate of 11 cubic feet per hour for two hours. Throughout the test, the coke bed temperature was maintained at 1800° F. The loss in coke weight was noted at 10 minute intervals. After two hours, the carbon dioxide flow was shut off, the reactor removed from the furnace and allowed to cool to room temperature. After cool down, the reacted coke was removed from the reactor, weighed and the percent of coke weight loss calculated.

Coke degradation was determined by screening the reacted coke using 1, ¾ and ⅜ inch screen sizes. The percent of plus 1, minus 1, plus ¾, and minus ⅜ inch coke was determined from the coke fraction weights. Since the coke charged for the reactivity test was sized to 100% plus 1 inch screen size, the percentage of plus 1 inch coke and the percentage of minus ⅜ inch coke fines after the reaction represents a measure of coke degradation during reaction.

As a further measure of coke quality, the coked blends with and without added silica were subjected to a standard ASTM Tumble Test and a stability factor index was determined. The testing procedure involved screening the coke blend to obtain a minus 3 inch plus 2 inch screen size fraction. The 3 by 2 inch coke was tumble tested according to ASTM designation D-29-50, and a stability factor for each blend representing the weight percent of plus 1 inch coke after tumbling was calculated.

The reactivity test results of the coked blends containing the different percentages of sized silica are reported in Tables I, II and III below. Included in these tables are the percentages of alkali added to the coke, the reactivity values, the size consists of the reacted coke, and the stability factors of the coked blends.

TABLE I

COKE REACTIVITY TEST — COKED BLEND WITH 20 × 50 MESH SILICA SAND (QUARTZITE) ADDITION

| Silica Added to Coal Blend, % by wt. | | | | | Reacted Coke, % by wt. | | | |
|---|---|---|---|---|---|---|---|---|
| Test Run | Coal | Coke | Alkali (Na) Added, % by wt. | Reactivity Value, % by wt. | +1 in. | +¾ in. | −⅜ in. | Stability Factor % by wt. +1 in. |
| 2365-73 | none | | none | 5.6 | 90.1 | 8.5 | 1.2 | 52.9 |
| 1907-26 | 1.4, 20×50 mesh, 2.0 | | none | 4.2 | 95.1 | 4.4 | 0.5 | 51.9 |
| 2365-54 | none | | 1.5 | 16.1 | 78.0 | 15.5 | 5.2 | 52.9 |
| 1907-30 | 1.4, 20×50 mesh, 2.0 | | 1.5 | 15.3 | 83.3 | 13.2 | 3.2 | 51.9 |

The adverse effect of alkali (Na) on reactivity and degradation will be apparent by comparing Run 2365-73 (no alkali) to Run 2365-54 (1.5% alkali). The presence of the alkali increased the reactivity value from 5.6 to 16.1 and decreased the amount of plus 1 inch size reacted coke from 90.1 to 78. The amount of minus ⅜ inch coke fines was increased from 1.2% to 5.2%.

At the 1.5% alkali level, the coked sample containing 2% of minus 20 plus 50 mesh size quartzite (Run 1907-30) showed a slight lowering in the reactivity value, a somewhat greater percent of plus 1 inch reacted coke, and a lower percent of minus ⅜ inch size than the coked sample without quartzite (Run 2365-54). This increase in the plus 1 inch size reacted coke from 78.0% for Run 2365-54 to 83.3% for Run 1907-30 along with a decrease in minus ⅜ inch fines from 5.2% (Run 2365-54) to 3.2% (Run 1907-30) represents an improvement affected by added silica on deterring alkali induced coke degradation.

TABLE II

COKE REACTIVITY TEST — COKED BLEND CONTAINING PERCENTAGES OF 100 × 0 MESH GROUND SILICA

| Silica Added to Blend, % by wt. | | | | | Reacted Coke, % by wt. | | | |
|---|---|---|---|---|---|---|---|---|
| Test Run | Coal | Coke | Alkali (Na) Added, % by wt. | Reactivity Value, % by wt. | +1 in. | +¾ in. | −⅜ in. | Stability Factor % by wt. +1 in. |
| 1907-40 | none | | none | 5.9 | 96.3 | 2.9 | 0.6 | 53.1 |
| 1907-44 | none | | 1.5 | 17.5 | 79.2 | 14.9 | 4.2 | 53.1 |
| 1907-82 | 1.4, 100 mesh, 2.0 | | 1.5 | 15.9 | 87.7 | 7.5 | 4.2 | 53.6 |
| 1907-83 | 2.1, 100 mesh, 3.0 | | 1.5 | 16.6 | 93.4 | 3.2 | 2.8 | 52.1 |
| 1907-46 | 2.8, 100 mesh, 4.0 | | 1.5 | 11.8 | 96.2 | 2.3 | 1.2 | 51.2 |

Silica sand ground to minus 100 mesh (Tyler) was blended in the coal blend prior to coking in 1.4%, 2.1% and 2.8% amounts. Results of the testing at these levels of added silica are reported in Table II. These results show that the coked blend (Run 1907-44) with alkali but without added silica resulted in a 79.2% plus 1 inch size reacted coke and a 4.2% minus ⅜ inch size fraction. When tested in the same alkali environment, the coked blend containing 2%, 3% and 4% silica resulted in 87.7%, 93.4% and 96.2% plus 1 inch and 4.2%, 2.8% and 1.2% minus ⅜ inch size reacted coke for Runs 1907-82, 83 and 46, respectively. Since the percent of plus 1 inch size reacted coke is a measure of the amount of coke degradation, these results demonstrate that the addition of increased amounts of silica is increasingly effective in lowering coke degradation.

TABLE III

COKE REACTIVITY TEST — COKED BLEND CONTAINING PERCENTAGES OF SILICA SAND

| Test Run | Silica Added to Blend, % Coal | Silica Added to Blend, % Coke | Alkali (Na) Added, % by wt. | Reactivity Value, % by wt. | Reacted Coke, % by wt. +1 in. | Reacted Coke, % by wt. +¾ in. | Reacted Coke, % by wt. −⅜ in. | Stability Factor % by wt. +1 in. |
|---|---|---|---|---|---|---|---|---|
| 2427-23 | none | | none | 6.4 | 92.2 | 6.8 | 0.9 | 51.7 |
| 2427-11 | none | | 1.5 | 17.0 | 73.7 | 20.7 | 3.7 | 51.7 |
| 2427-12 | 0.7, 100 mesh, 1.0 | | 1.5 | 18.5 | 76.9 | 18.4 | 3.6 | 53.5 |
| 2427-16 | 0.7, 200 mesh, 1.0 | | 1.5 | 15.2 | 77.3 | 19.3 | 3.0 | 54.2 |
| 2427-8 | 1.4, 100 mesh, 2.0 | | 1.5 | 17.2 | 84.0 | 11.9 | 3.3 | 51.7 |
| 2427-22 | 1.4, 120 mesh, 2.0 | | 1.5 | 15.4 | 85.8 | 11.3 | 2.4 | 52.3 |
| 2427-7 | 2.1, 100 mesh, 3.0 | | 1.5 | 14.9 | 87.0 | 9.2 | 2.9 | 52.2 |
| 2427-24 | 2.1, 120 mesh, 3.0 | | 1.5 | 14.8 | 92.5 | 5.5 | 1.9 | 53.4 |

NOTE:
100 mesh silica sand, 47.5% passing 100 mesh screen.
120 mesh silica sand, 77.5% passing 100 mesh screen.
200 mesh silica sand, 96.0% passing 200 mesh screen.

Samples of various size grades of silica sand were obtained from a commercial source and different percentages of the sand were blended with the tested coal blends. The reactivity test results are presented in Table III. These results show a progressive increase in the percent of plus 1 inch size reacted coke and a decrease in the percent of minus ⅜ inch coke fines as the percent of added silica was increased to about 3% of the coke blend. The 3% addition in the coked blend (2.1% addition to the coal blend) of 120 mesh silica sand (Run 2427-24) was the most effective of the silica additions in minimizing coke degradation. The coked blend resulted in 92.5% plus 1 inch size reacted coke and 1.9% minus ⅜ inch coke size as compared to 92.2% plus 1 inch size reacted coke and 0.9% minus ⅜ inch size without added alkali (Run 2427-23) and to 73.7% plus 1 inch size reacted coke and 3.7% minus ⅜ inch coke size with alkali without added silica (Run 2427-11). The results reported in Table III also show that the finer 120 mesh silica sand at each percentage level gave a higher percentage of plus 1 inch reacted coke than the coarser 100 mesh silica addition. The effectiveness of the finer silica in lowering coke degradation is demonstrated by comparing the 85.8% plus 1 inch size reacted coke and 2.4% minus ⅜ inch coke fines for the coke containing the 2% addition of 120 mesh silica (Run 2427-22) with the 87.0% plus 1 inch size reacted coke and 2.9% minus ⅜ inch coke size for coke containing the 3% addition of 100 mesh silica (Run 2427-7).

The preferred 120 mesh silica had the following Tyler screen analysis and chemistry:

| Sieve Analysis | Percent Passing |
|---|---|
| 100 Mesh | 77.5 |
| 140 Mesh | 62.5 |
| 200 Mesh | 51.5 |
| 325 Mesh | 35.0 |
| Chemistry | Percent |
| $SiO_2$ | 99.00 |
| $Fe_2O_3$ | 0.18 |
| $Al_2O_3$ | 0.60 |
| $TiO_2$ | 0.03 |
| LOI | 0.17 |

In each of the tables discussed above, the stability factors for the coked blends tested with and without added silica are listed. Comparison of the data at the different silica levels shows that the stability factor of the tested coked blend was not significantly affected by silica additions up to 4% contained in the coke.

In summary of the foregoing, results of the tests show that added silica, preferably a silica flour having a size no larger than about 75% minus 100 mesh, in a minimum amount of about 0.7% by weight of the coal blend which corresponds to about 1% by weight of the coked blend is effective to significantly retard coke degradation resulting from an alkali environment, and that the most pronounced improvements are obtained when the silica is added in a minimum amount of about 1.4% of the coal or about 2% by weight of the coke. The improvements in coke degradation are progressively increased by increased amounts of added silica in the coked blend up to at least 2.8% by weight of the coal or about 4% by weight of the coke. The tests further show that the $CO_2$ reactivity of coked blends in an alkali environment is decreased by added silica.

Various modifications and variations of the invention will be apparent to those skilled in the art in the light of the foregoing detailed disclosure. Therefore, it is to be understood that, within the scope of the appended claims, the invention can be practiced otherwise than as specifically described.

What is claimed is:

1. In the process of operating a blast furnace by charging ore, coke and flux into the furnace and reducing the ore by oxidation of the coke, the improvement comprising the steps of employing coke derived from coal and enriched with an addition of at least 1% by weight of finely dispersed silica as the coke charge, and allowing the silica to react with condensed alkalis on the coke to form alkali silicates and thereby retard coke degradation.

2. The improvement as claimed in claim 1 wherein the coke charged into the furnace contains from about 2% to about 4% by weight silica.

3. In the process of operating a blast furnace by charging ore, coke and flux into the furnace and reducing the ore by oxidizing the coke, the improvement comprising the steps of employing silica enriched coke as the coke charge, said silica enriched coke having been prepared by coking coal containing a finely dispersed addition of silica in an amount of at least 0.7% by weight of the coal, said silica having a size no greater than about 75% minus 100 mesh, and allowing the silica to react in the furnace with condensed alkalis on the coke to form alkali silicates and thereby retard coke degradation.

* * * * *